US006943322B1

(12) United States Patent
Whipple, Jr.

(10) Patent No.: US 6,943,322 B1
(45) Date of Patent: Sep. 13, 2005

(54) PRESSURE EXHAUST SYSTEM FOR A CONVECTION COOKING APPLIANCE

(75) Inventor: Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/824,416

(22) Filed: Apr. 15, 2004

(51) Int. Cl.[7] ..... A21B 1/26; F24C 15/32
(52) U.S. Cl. ..... 219/400; 126/21 A
(58) Field of Search ..... 219/400, 681, 219/683; 99/474–476; 126/21 A

(56) References Cited

U.S. PATENT DOCUMENTS 4,395,233 A 7/1983 Smith et al.
4,430,541 A 2/1984 Day, Jr.
4,430,989 A 2/1984 Narang et al.
4,516,012 A 5/1985 Smith et al.
4,954,693 A * 9/1990 Mitsuhashi et al. ..... 219/400
5,918,589 A 7/1999 Valle et al.
6,718,965 B2 * 4/2004 Rummel et al. ..... 126/21 A

FOREIGN PATENT DOCUMENTS

DE 2158557 B * 10/1975

* cited by examiner

*Primary Examiner*—Joseph Pelham
(74) *Attorney, Agent, or Firm*—Diederiks & Whitelaw, PLC; Allan P. Orsund

(57) ABSTRACT

A cooking appliance incorporates a convection heating system including a housing having an interior portion, a fan assembly, a heating element and an exhaust outlet duct. The exhaust outlet duct, within which is arranged a plurality of controlled vent openings, is positioned in a high pressure area of the convection heating system established about a periphery of the fan assembly and heating element. Oven gases are forced by the high pressure through the exhaust duct, thereby creating a corresponding reduction in pressure. The reduction in pressure establishes a low pressure area within the fan assembly which draws in fresh air in an amount equal to that exhausted through the exhaust duct.

30 Claims, 3 Drawing Sheets

PRESSURE EXHAUST SYSTEM FOR A CONVECTION COOKING APPLIANCE

BACKGROUND OF THE INVENTION

1. Field of the Invention

The present invention pertains to the art of cooking appliances and, more particularly, to a cooking appliance including a convection cooking system having a controlled exhaust outlet that establishes a pressure differential within the convection cooking system causing fresh air to be drawn into the appliance.

2. Discussion of the Prior Art

In the art of cooking, it is common to incorporate a convection cooking system in an oven for performing a particular cooking process. Typically, convection cooking systems include a fan for establishing a heated airflow by passing oven gases over a heating element prior to re-introducing the airflow into the oven. In addition to the heated airflow, provisions must be made to exhaust a portion of the oven gases from the oven. Therefore, the convection cooking system must include structure designed to ventilate or evacuate exhaust gases from the appliance.

There are two key components associated with the design of oven ventilation systems. The primary concern is the build-up of gases which include carbon monoxide (CO) and carbon dioxide ($CO_2$) within the oven. If the gases are evacuated from the oven too quickly, the efficiency of the cooking process, as well as oven pre-heat time, will be reduced. On the other hand, if the gases are evacuated too slowly, a large smoke cloud could pour forth into the kitchen after completion of a closed door cooking process and, in particular, a broil operation. Thus, the ventilation system must be designed to handle the dissipation of the smoke cloud, as well as to promote overall oven efficiency.

The second key component in the design of an oven ventilation system is controlling oven gas exhaust temperature. That is, the temperature of the exhausting oven gases should not be too hot or too low. For example, permitting the exhaust gas temperature to be too low will undesirably develop condensation of the food effluents and steam as the exhaust gases exit the oven.

Several attempts have been made to develop better ventilation systems for ovens. In general, such systems require extensive ducting, catalyst reactors, outlet baffles or the like. While each is effective to a degree, all require the use of additional, expensive components or systems which add to the overall cost and complexity of the oven. In the highly competitive field of cooking appliances, it is important to deliver a product at a low cost, while maintaining quality and efficiency standards. Therefore, despite the existence of various oven ventilation systems in the prior art, there still exists a need for a low cost, relatively simple oven ventilation system that provides the proper balance between exhaust gas temperature and exit velocity.

SUMMARY OF THE INVENTION

The present invention is directed to a cooking appliance incorporating a convection heating system including a ventilation arrangement having a pressure exhaust system. Specifically, the convection system includes a housing unit having an interior portion within which is arranged at least a fan assembly, a heating element and an exhaust outlet portion. The exhaust outlet portion has arranged therein a plurality of controlled, vented openings, the number and size of which control a flow rate and volume of exhaust gases exiting the appliance.

In accordance with a preferred form of the invention, the heating element, preferably a sheathed, electric resistive element in the form of a halo, is positioned outside a perimeter of the fan assembly such that an airflow generated by the fan passes over the heating element. With this arrangement, a high pressure area is established just outside the fan perimeter and around the heating element. In a preferred arrangement, the exhaust outlet portion is positioned within the high pressure area such that a portion of the airflow is forced out at a controlled rate through the vented openings.

Correspondingly, as the airflow passes through the exhaust outlet, a slight reduction in pressure occurs creating a low pressure zone within the convection system. This pressure reduction is most pronounced at an inner portion of the fan assembly. Therefore, oven gases passing from the system at an established rate cause fresh air to be drawn into the system at a corresponding rate. With this arrangement, oxygen ($O_2$) is available in sufficient amounts to provide for substantially complete combustion of airborne byproducts. Accordingly, a reduction of smoke, condensation and built-up food effluents is realized within the cooking appliance. Furthermore, CO generated by the cooking process is maintained at minimum levels such that smoke and other emissions remain below industry standards. Moreover, by controlling the exhaust flow rate, gases carried through the exhaust ducts have sufficient time to cool prior to being released into the surrounding environment.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
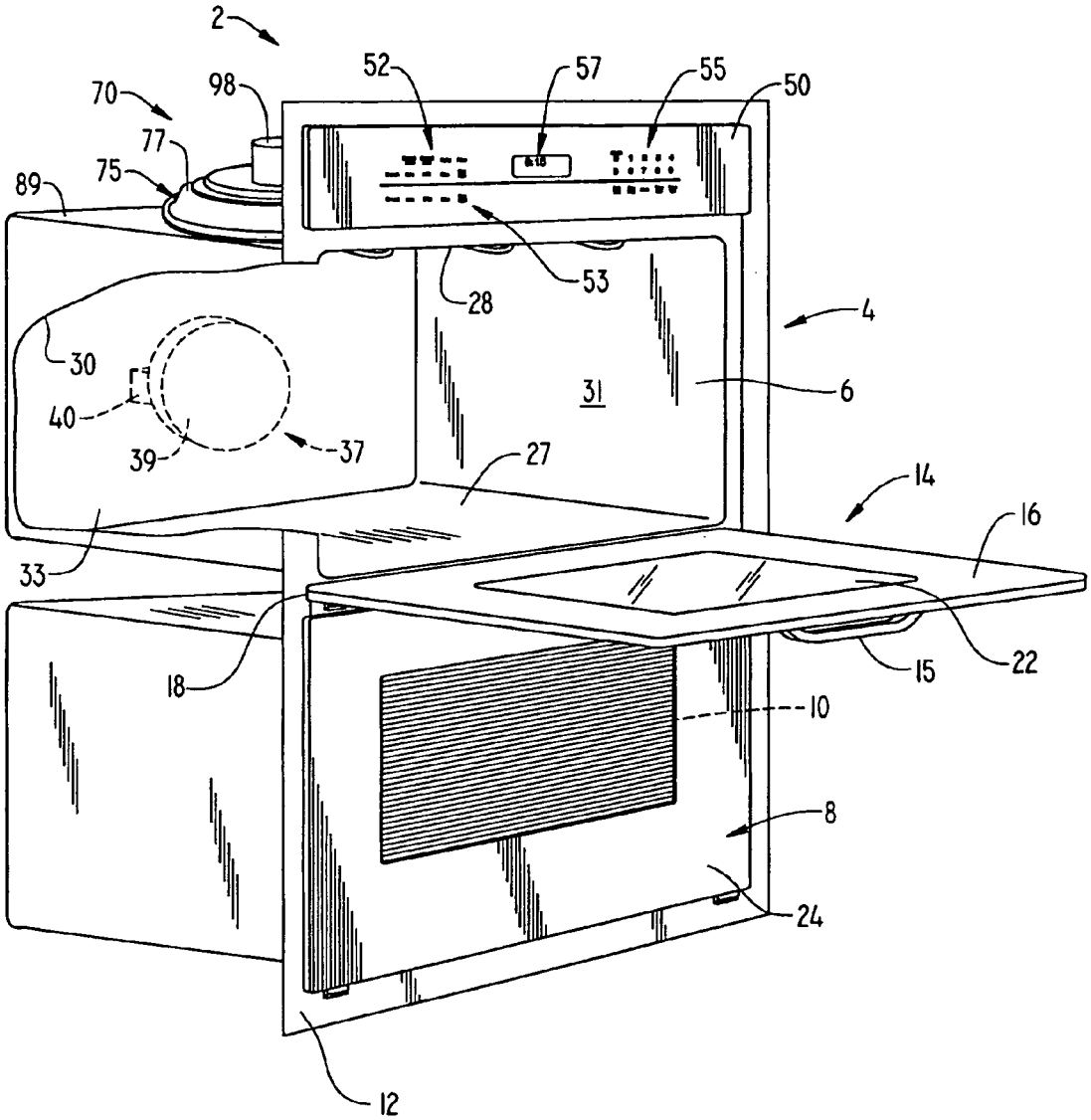
FIG. 1 is a partial perspective view of a cooking appliance, shown in the form of a wall oven, including an overall convection and pressure exhaust system constructed in accordance with the present invention.

With initial reference to FIG. 1, a cooking appliance constructed in accordance with the present invention is generally illustrated at 2. Although cooking appliance 2 is depicted as a dual wall oven, it should be understood that the present invention is not limited to this particular model type and can be incorporated into various other types of oven configurations, e.g., cabinet mounted ovens, free-standing ranges and slide-in ranges. In the embodiment shown, cooking appliance 2 includes an upper oven 4 having upper oven cavity 6 and a lower oven 8 including a lower oven cavity 10. Upper oven 4 is preferably designed to perform a combination microwave/convection cooking process, while lower oven 8 is adapted to perform a conventional, radiant cooking operation. As shown, cooking appliance 2 includes an outer frame 12 for, at least partially, supporting both upper oven 4 and lower oven 8 within associated wall structure (not shown).

In a manner known in the art, a door assembly 14 is provided to selectively provide access to upper oven cavity 6. As shown, door assembly 14 is also provided with a handle 15 at an upper portion 16 thereof. As further shown in FIG. 1, door assembly 14 is adapted to pivot at a lower portion 18 to enable selective access to within oven cavity 6. In a manner also known in the art, door assembly 14 is provided with a transparent zone 22 for viewing the contents of oven cavity 6 when door assembly 14 is closed. In addition, a seal (not shown) is provided about a peripheral edge portion (not separately labeled) of door assembly 14 to prevent oven gases from undesirably escaping from oven cavity 6. In a similar manner, a second door assembly 24 is provided for lower oven 8.

As best seen in FIG. 1, oven cavity 6 is defined by a bottom portion 27, an upper portion 28, opposing side portions 30 and 31 and a rear portion 33. In the illustrated embodiment, arranged on an outer rear surface of upper oven 4 is a microwave cooking system generally indicated in phantom at 37. As shown, microwave cooking system 37 includes a waveguide 39 having arranged thereon a microwave emitter or magnetron 40. As further shown in FIG. 1, cooking appliance 2 includes an upper control panel 50 arranged above upper oven 4 and carried at least partially by frame 12. In the embodiment shown, control panel 50 includes first and second rows of oven control buttons 52 and 53 for programming, in combination with a numeric pad 55 and a display 57, particular cooking operations for upper and lower ovens 4 and 8 respectively. Since the general programming and operation of cooking appliance 2 is known in the art and does not form part of the present invention, these features will not be discussed further here. Instead, the general structure described above with respect to cooking appliance 2 is already known in the art and does not constitute part of the present invention. Therefore, this structure has only been described for the sake of completeness. Instead, the present invention is particularly directed to a convection heat system and, more particularly, to a convection heat system incorporating a pressure exhaust system.

Figure 2:
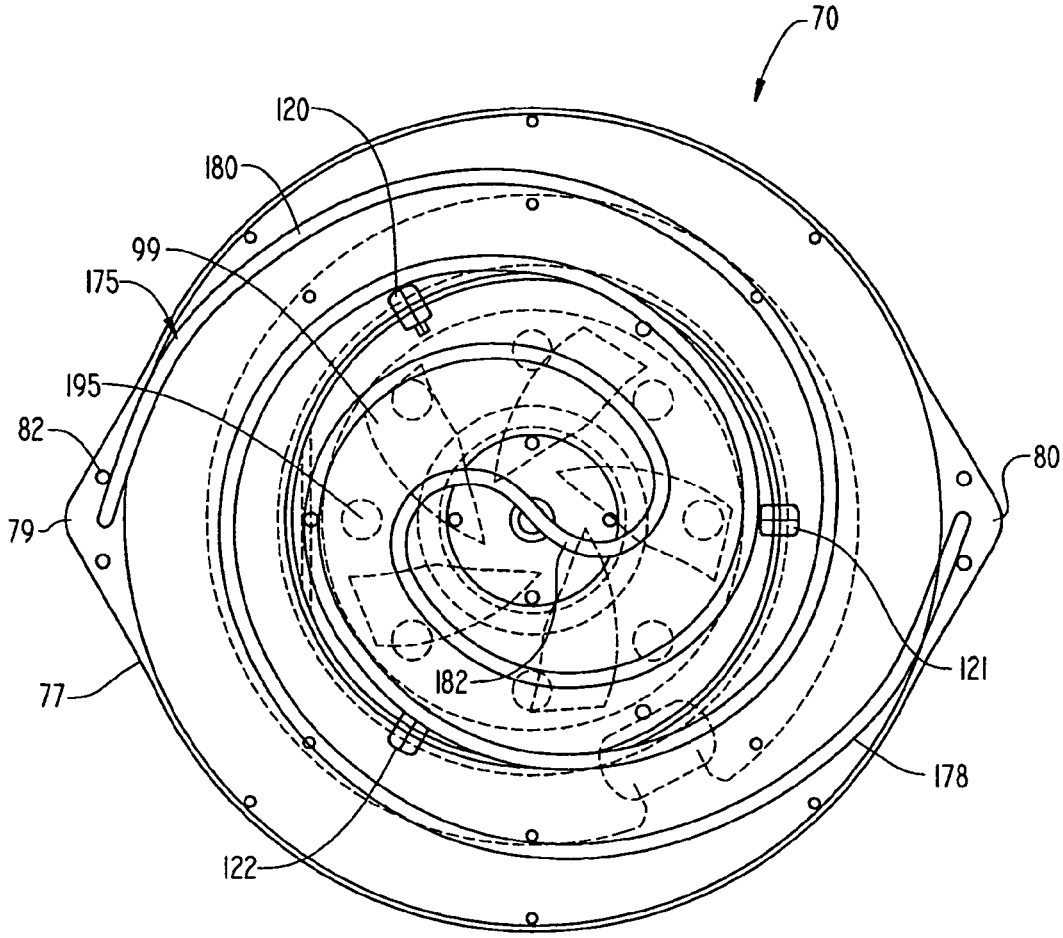
FIG. 2 is a plan view of the overall convection and pressure exhaust system of FIG. 1.
Figure 3:
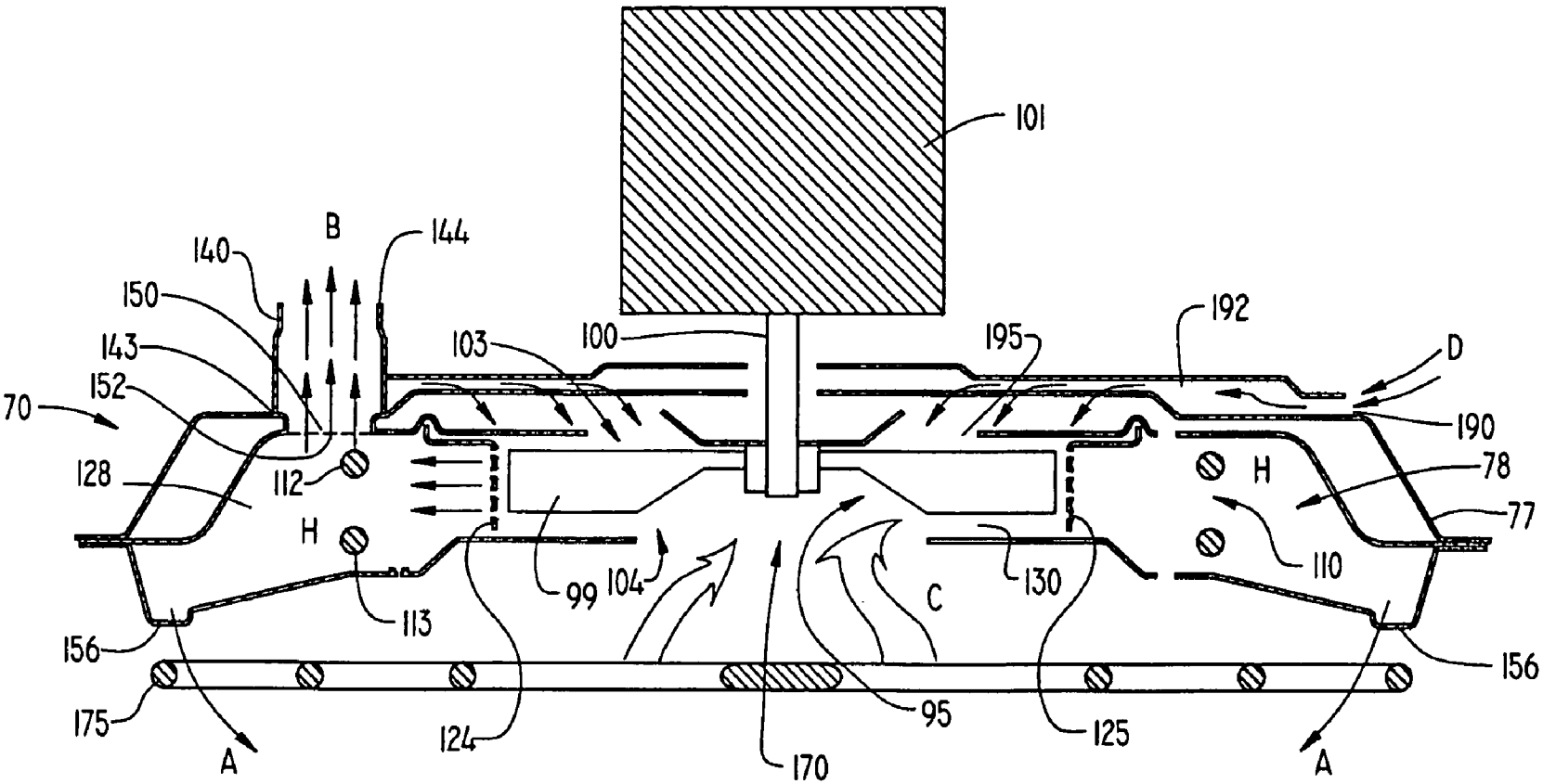
FIG. 3 is a cross-sectional side view of the convection and pressure exhaust system of FIG. 2.

Referring to FIGS. 1–3 illustrating a preferred embodiment of the present invention, cooking appliance 2 further includes a convection heating system indicated generally at 70. As shown, convection heating system 70 includes a convection fan housing 75 having an outer peripheral portion 77 and an interior portion or chamber 78. Extending from opposing side portions of outer peripheral portion 77 are mounting flanges 79 and 80, each of which includes a plurality of apertures 82 for securing convection heating system 70 to an upper exterior portion 89 of oven cavity 6.

As best seen in FIG. 3, arranged within interior portion 78 of housing 75 is a fan assembly 95. In the embodiment shown, fan assembly 95 includes a fan 99 which is driven by a drive shaft 100 of a motor 101. More specifically, fan 99 constitutes a dual flow blower having a first portion 103 adapted to establish an incoming air flow and a second portion 104 adapted to withdraw oven gases from within oven cavity 6.

Arranged about an outer periphery of fan 99 within housing 75 is a heating element 110 which, in accordance with a preferred form of the invention, includes first and second coils 112 and 113. Heating element 110 is secured within interior portion 78 of housing 75 by a plurality of heating element support brackets 120–122 as shown in FIG. 2. As best illustrated in FIG. 3, a peripheral wall 124 extends about interior portion 78 of housing 75 between fan 99 and heating element 110. In the embodiment shown, peripheral wall 124 extends radially outwardly of fan 99 and includes a plurality of openings indicated generally at 125. As will discussed more fully below, peripheral wall 124 separates interior portion 78 into an outer chamber 128 and an inner chamber 130.

In accordance with the most preferred form of the present invention, an exhaust duct 140 extends from an upper surface of housing 75, with exhaust duct 140 having a first end 143 opening into outer chamber 128 and extending to a second end 144 which opens to outer chamber 128 for exhaust gases from cooking appliance 2. More specifically, arranged at first end 143 of exhaust duct 140 is a restricter plate 150 including a plurality of controlled openings 152 which, in this most preferred embodiment, establish a flow rate and volume of the exhaust gases exiting from outer chamber 128 through exhaust duct 140.

Having described a preferred construction of the convection cooking system of the present invention, reference will now be made to FIGS. 1–3 in describing a preferred method of operation. Upon application of an electric current to motor 101, fan 99 begins to rotate so as to establish an air flow within interior portion 78 of housing 75. Initially, the air flow developed by operation of fan 99 passes through openings 125 in peripheral wall 124, thereby creating a high pressure zone indicated at H within outer chamber 128. The development of the high pressure zone H forces a first portion of the air flow (indicated generally at A) through outlets 156 of housing 75 which open into oven cavity 6. At the same time, the high pressure zone H forces a second portion of the air flow through openings 152 in restricter plate 150, thereby establishing an exhaust air flow. The exhaust airflow is subsequently directed through duct 140 and away from cooking appliance 2.

In accordance with the invention, the flow rate of exhaust gases through duct 140 is established by a pressure differential between outer chamber 128 and the restriction created by restricter plate 150. Depending upon the particular geometries of the overall cooking appliance, openings 152 can be adjusted in both number and size to allow a greater or lesser amount of exhaust gases to pass from outer chamber 128 into exhaust duct 140. In addition to performing a cooking operation with the above described convection cooking system, appliance 2 includes a broil element 175 mounted adjacent housing 75 within oven cavity 6. As shown, broil element 175 includes a first, generally spiral shaped portion 178 interconnected to a second, generally spiral shaped end portion 180 through an intermediate S-shaped portion 182. With this construction, upon selection of a broil operation, broil element 175 is activated to efficiently and effectively direct heat upon a food item positioned there below.

As the air flow passes through outer chamber 128, a corresponding low pressure area, which is generally indicated at L in FIG. 3, is established within inner chamber 130. Low pressure zone L draws fresh air into housing 75 through inlet portion 190. As shown, a fresh air flow, generally indicated at D, enters inlet portion 190, travels through a passage 192 and flows into inner compartment 130 through openings 195. In this manner, the level of oxygen ($O_2$) present within convection heating system 70 can be controlled such that the combustion of food effluents is maintained within accepted industry standards. In addition, controlling the level of oxygen ($O_2$) within the system lowers the carbon monoxide generated to absolute minimum levels as determined by the thermodynamics of the overall system.

In accordance with the most preferred form of the present invention, air flow generated by fan assembly 95 is constituted in part by oven gases withdrawn from oven cavity 6 through intake portion 170. As oven gases generally contain food effluents, directing the oven gases over heating element 110 in the presence of the incoming, fresh air flow enhances the overall combustion of food effluents.

Although described with reference to a preferred embodiment of the present invention, it should be readily apparent to one of ordinary skill in the art that various changes and/or modifications can be made to the invention without departing from the spirit thereof. For instance, it is contemplated that interchanging the respective positions of the convection heating system and the microwave heating system fall within the scope of the present invention. In addition, while the broiler element is shown to be substantially spiral in shape, a wide variety of broiler element configurations, such as a standard serpentine element, could be employed. In general, the invention is only intended to be limited to the scope of the following claims.

What is claimed is:

1. A cooking appliance comprising:

an oven cavity having an upper portion; and a convection heating system positioned to deliver a convective air flow into the oven cavity, said convection heating system including:

a housing including an interior chamber, an inlet portion, and an outlet portion opening to the oven cavity, each of said inlet portion and said outlet portion being fluidly connected to the interior chamber;

a fan rotatably mounted in the interior chamber; and an exhaust outlet portion having a first end portion opening to the interior chamber, a second end portion exposed to a surrounding environment, and an intermediate portion, said exhaust outlet portion being provided with a plurality of vent openings sized to establish a controlled control a flow rate of exhaust gases discharged from the interior chamber of the convection heating system.

2. The cooking appliance according to claim 1, further comprising: a heating element positioned within the interior chamber.

3. The cooking appliance according to claim 2, wherein the heating element is arranged radially outwardly of the fan.

4. The cooking appliance as recited in claim 3, wherein the exhaust outlet portion is positioned radially outwardly of the fan, adjacent to the heating element.

5. The cooking appliance as recited in claim 1, further comprising: a restrictor plate positioned in the exhaust outlet portion, with said restrictor plate being formed with the plurality of vent openings.

6. The cooking appliance as recited in claim 1, wherein the housing includes an outer peripheral rim and a central portion, wherein the outlet portion of the housing includes a plurality of openings arranged in the outer peripheral rim of the housing and exposed to the oven cavity.

7. The cooking appliance according to claim 6, wherein the inlet portion of the housing includes a plurality of inlet openings arranged about the central portion, said plurality of inlet openings being adapted to receive an oven air flow from the oven cavity to within the interior chamber of the housing.

8. The cooking appliance as recited in claim 6, further comprising: a broil element extending within the oven cavity, said broil element being carried by the housing.

9. The cooking appliance as recited in claim 8, wherein the broil element has a first end portion having a generally spiral shape, a second end portion having a generally spiral shape, and an intermediate, generally S-shape portion interconnecting the first and second end portions.

10. The cooking appliance as recited in claim 3, wherein the heating element is constituted by a sheathed electric resistive heating element defining a plurality of ring portions.

11. The cooking appliance as recited in claim 1, wherein the convection heating system is mounted on the upper portion of the oven cavity.

12. The cooking appliance as recited in claim 1, further comprising: a peripheral wall provided in the interior chamber between the fan and the exhaust outlet portion, said peripheral wall dividing the interior chamber during operation of the convection heating system, into an inner, high pressure chamber and an outer, lower pressure chamber.

13. The cooking appliance as recited in claim 12, wherein the inlet portion opens to the low pressure chamber.

14. The cooking appliance as recited in claim 13, wherein the exhaust outlet portion is open to the high pressure chamber.

15. The cooking appliance as recited in claim 2, further comprising: a microwave cooking system adapted to introduce microwaves into the oven cavity.

16. A convection heating system for a cooking appliance comprising:

an oven cavity; and a convection heating system positioned to deliver a convective air flow into the oven cavity, said convection heating system including:

a housing including an interior chamber, an inlet portion, and an outlet portion opening to the oven cavity, each of said inlet portion and said outlet portion being fluidly connected to the interior chamber;

a fan rotatably mounted in the interior chamber;

an exhaust outlet portion having a first end portion opening to the interior chamber, a second end portion exposed to a surrounding environment, and an intermediate portion, said exhaust outlet portion being provided with a plurality of vent openings sized to establish a controlled flow rate of exhaust gases discharged from the interior chamber of the convection heating system.

17. The convection heating system as recited in claim 16, further comprising: a heating element positioned within the interior chamber.

18. The convection heating system as recited in claim 17, wherein the heating element is arranged radially outwardly of the fan.

19. The convection heating system as recited in claim 18, wherein the exhaust outlet portion is positioned radially outwardly of the fan, adjacent to the heating element.

20. The convection heating system as recited in claim 16, further comprising: a restrictor plate positioned in the exhaust outlet portion, with said restrictor plate being formed with the plurality of vent openings.

21. The convection heating system as recited in claim 16, further comprising: a broil element extending within the oven cavity, said broil element being carried by the housing.

22. The convection heating system as recited in claim 21, wherein the broil element has a first end having a generally spiral shape, a second end having a generally spiral shape, and an intermediate, generally S-shape portion interconnecting the first and second ends.

23. The convection heating system as recited in claim 16, further comprising: a peripheral wall provided in the interior chamber between the fan and the exhaust outlet portion, said peripheral wall dividing the interior chamber during operation of the convection heating system, into an inner, high pressure chamber and an outer, lower pressure chamber.

24. The convection heating system as recited in claim 23, wherein the inlet portion opens to the low pressure chamber.

25. The convection heating system as recited in claim 24, wherein the exhaust outlet portion is open to the high pressure chamber.

26. A method of operating a cooking appliance including an oven cavity through which air flows for convection cooking purposes comprising:

rotating a fan mounted in an interior chamber of a housing;

drawing in a flow of oven air into the housing upon rotation of the fan;

creating high and low pressure zones in the interior chamber;

drawing in a flow of fresh air in the low pressure zone;

mixing the flow of oven air with the flow of fresh air to create a combined flow of air;

exhausting a controlled portion of the combined flow of air from the cooking appliance through a plurality of vent openings provided in an exhaust outlet arranged in the high pressure zone; and directing another portion of the combined flow of air into the oven cavity.

27. The method of claim 26, further comprising: heating the combined flow of air in the high pressure zone of the interior chamber.

28. The method of claim 27, further comprising: positioning a restrictor plate, formed with the plurality of vent openings, in the exhaust outlet to regulate the controlled portion of the combined flow of air.

29. The method of claim 27, further comprising: causing the flow of oven air to be directed radially outwardly of the fan through openings formed in a peripheral wall arranged in the housing between the fan and the exhaust outlet in order to establish the high and low pressure zones.

30. The method of claim 27, further comprising: activating an electric broil element arranged in the oven cavity and carried by the housing.

* * * * *